United States Patent [19]

Bodine

[11] Patent Number: 4,716,555

[45] **Date of Patent: * Dec. 29, 1987**

[54] SONIC METHOD FOR FACILITATING THE FRACTURING OF EARTHEN FORMATIONS IN WELL BORE HOLES

[76] Inventor: Albert G. Bodine, 7877 Woodley Ave., Van Nuys, Calif. 91406

[ * ] Notice: The portion of the term of this patent subsequent to Dec. 11, 2001 has been disclaimed.

[21] Appl. No.: 748,161

[22] Filed: Jun. 24, 1985

[51] Int. Cl.[4] ..... G01V 1/00

[52] U.S. Cl. ..... 367/35; 166/308; 166/249

[58] Field of Search ..... 367/35, 14; 181/106, 181/104, 111, 105, 113; 166/308, 249

[56] References Cited

U.S. PATENT DOCUMENTS

| | | | |
|---|---|---|---|
| 3,965,982 | 6/1976 | Medlin | 166/308 |
| 4,358,248 | 11/1982 | Bodine | 417/241 |
| 4,432,078 | 2/1984 | Silverman | 367/14 |
| 4,487,554 | 12/1984 | Bodine | 417/241 |

*Primary Examiner*—Thomas H. Tarcza

*Assistant Examiner*—Daniel T. Pihulic

*Attorney, Agent, or Firm*—Edward A. Sokolski

[57] ABSTRACT

A pressurized liquid column is fed down the tubing string of a well and out of the well to the earthen formation at the bottom of the string. Mounted within the tubing string is an elastic rod string and the tubing plus the rod may comprise an elastic column. A vibration generator which may comprise an orbiting mass oscillator is mounted on the top of the rod string or both rod and tubing, the oscillator being operated at a sonic frequency which will effect resonant standing wave vibration of the rod string, A plurality of sonic impeller elements are fixedly mounted on the rod string at spaced intervals therealong, the spacing between such impeller elements being les than 1/10th of the wave length of the standing waves. The impeller elements are designed and oriented so as to effect downward pumping action of the liquid column in response to the sonic energy. This pumping action effects high pressure pulses against the earthen formation which causes fracturing thereof so as to create fissures therein; thereby enhancing the yield of the well.

4 Claims, 4 Drawing Figures

SONIC METHOD FOR FACILITATING THE FRACTURING OF EARTHEN FORMATIONS IN WELL BORE HOLES

SPECIFICATION

This invention relates to well fracturing to improve the draining of fluid thereform, and more particularly, to such a procedure in which sonic energy is employed to enhance the fracturing.

In the servicing of wells, particularly in the case of oil wells, a common procedure which is employed to increase the yield of the well involves a fracturing operation for creating cracks or fisures in the earthen formation around the well. Such fracturing aids the desired draining of fluid from the formation into the well. Typically, this servicing procedure involves the connection of high pressure pumps to the well head by means of which liquid is pumped down the well at a high enough pressure and rate so as to overcome the natural compression or compaction of the walls of the well at the depth interval to be fractured, and from which interval the desired drainage enhancement is to be accomplished. The earthen formation is thus effectively fissured and fractured by the intrusion of powerful momentary hydraulic pressure. The injected liquid normally also has a high strength sand mixed therein which is left behind in the newly formed cracks and fissures to function as a granular propping agent to keep these fractures slightly opened after the pressurizing is discontinued and the service pumps are removed from the well head. As the depth of the well increases, so also the required fracturing pressure increases, and eventually it becomes difficult to generate sufficient pressure to achieve the desired fracturing action.

The system of the present invention utilizes down hole sonic pumping action to substantially boost the normal pumping action from the surface to provide the needed additional down hole pressure required, particularly in the case of deeper wells. It is to be noted that while the sonic pumping arrangement of the present invention can, by itself, generate fracturing pressures, it is highly desirable to combine the sonic pumping action along with the surface pumping action, particularly in the case of deeper wells.

It is therefore an object of this invention to facilitate the fracturing of earthen formations in well bores to enhance the yield obtained from the well.

It is a further object of this invention to provide down hole sonic pumping action to enhance well fracturing action of surface located pumps.

Other objects of the invention will become apparent as the description proceeds in connection with the accompanying drawings of which:

Figure 1:
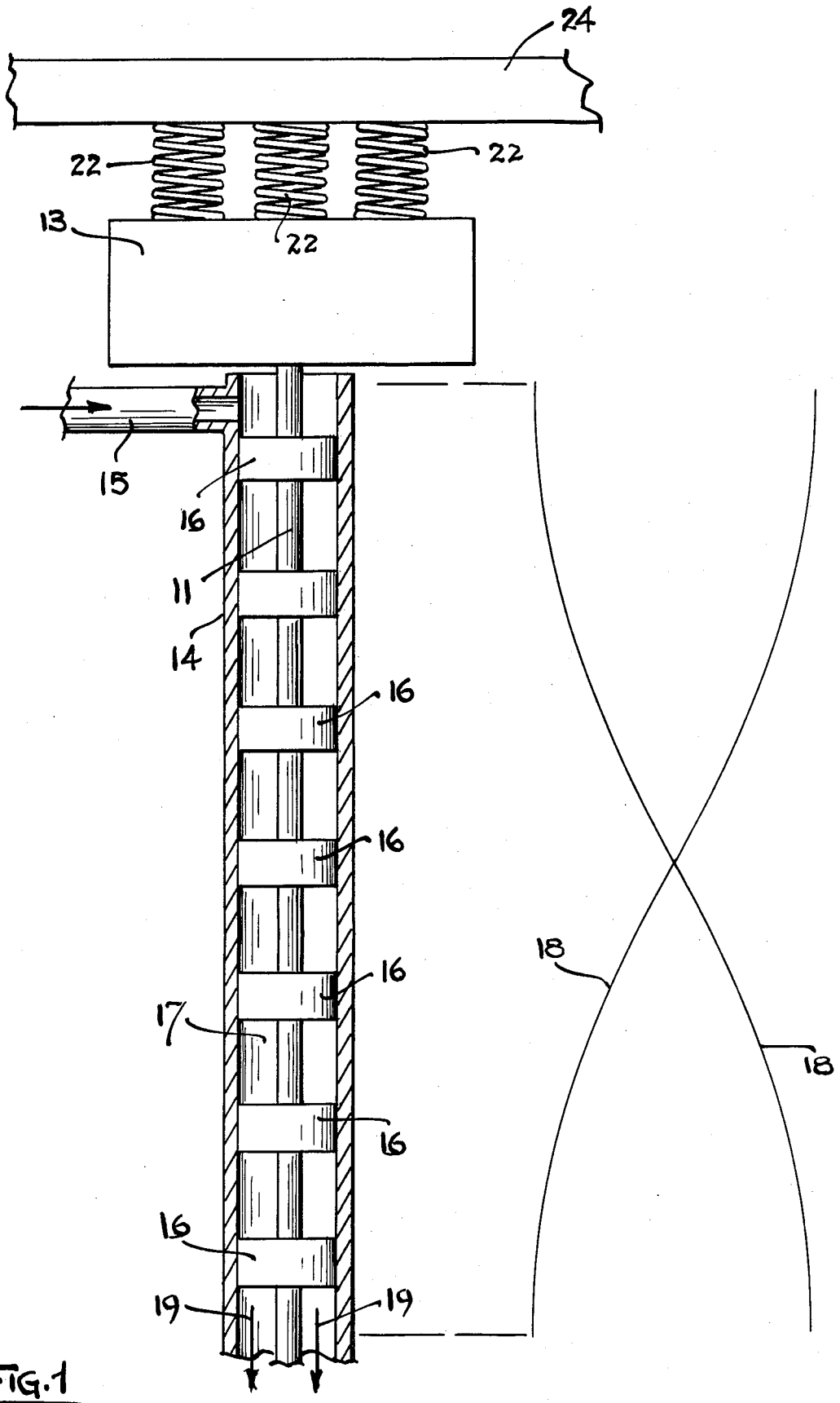
FIG. 1 is a schematic drawing illustrating the operation of the system of the invention.

Referring now FIG. 1, the system of the invention is schematically illustrated. Rod string 11 is suspended from vibration generator 13 and within tubing string 14 and the tubing 14 may likewise be so suspended. Vibration generator 13 may comprise an orbiting mass oscillator and an appropriate rotary drive mechanism as described in my U.S. Pat. No. 4,358,248, issued Nov. 9, 1982 and U.S. Pat. No. 4,487,544, issued Dec. 11, 1984. Rod 11 is solid and is fabricated of a highly elastic material such as steel and similar material may be used for tubing 14. The vibrational output of vibrational generator 13 which as already noted, includes an orbiting mass oscillator is coupled to rod 11, as described in U.S. Pat. No. 4,487,554 or to both rod 11 and tubing 14 as in U.S. Pat. No. 4,358,248. The orbiting mass oscillator of sonic generator 13 is operated at a frequency such as to cause resonant longitudinal standing wave vibration of the elastic column, which in the illustrative embodiment, includes rod 11; this standing wave vibration being shown by graph lines 18.

A plurality of sonic fluid impeller units 16 are fixedly mounted on rod 11 at spaced intervals therealong, the spacing between adjacent impeller units being less than 1/10th the wavelength of standing waves 18 so as to insure the delivery of sonic downward pulses to the pre-pressured column. An annulus 17 is formed between the inner wall of tubing 14 and the outer wall of rod 14. The impellers 16 are designed and oriented to provide downward pumping action in the pre-pressured liquid annulus column, as indicated by arrows 19, this in response to the sonic energy generated in the column which typically includes rod string 11. Pressurized fluid is fed into the sonically energized liquid annulus formed in the tubing string through surface inlet 15 such as to assure a solid column of liquid therein, the pressurization of such inlet fluid being achieved by means of a surface pump (not shown). Typically, the surface fluid is pressurized to a level of the order of several hundred—several thousand psi, as may be required to keep the sonically driven annulus at maximized acoustic impedance. The fluid fed in through inlet 15 is typically water mixed with sand. A downward bias force is applied to the elastic column 11 to counteract the tendency of the downward sonic pumping action to lift the column out of the well. This end result may be achieved by installing coiled springs 22 which are compressed between the top of the housing of vibration generator 13 and fixed structural member 24. The general structure of the sonic pumping system of the present invention is similar to that described in my U.S. Pat. No. 4,487,554, dated Dec. 11, 1984 and U.S. Pat. No. 4,358,248 dated Nov. 9, 1982, the disclosures of which are incorporated herein by reference.

The sonic impeller units 16 may take various forms. For illustrative purposes, the type of impeller described in my aforementioned U.S. Pat. No. 4,481,554 will be described in connection with FIGS. 2, 2A and 2B. Other types of impellers such as, for example, that described in my U.S. Pat. No. 4,358,248, issued Nov. 9, 1982, may also be employed. It is to be noted, however that the impellers described in these patents are used for pumping fluid upwardly out of the well, so that for the present application, they must be inverted so as to provide pumping action downwardly out of the well and into the formation.

Figure 2:
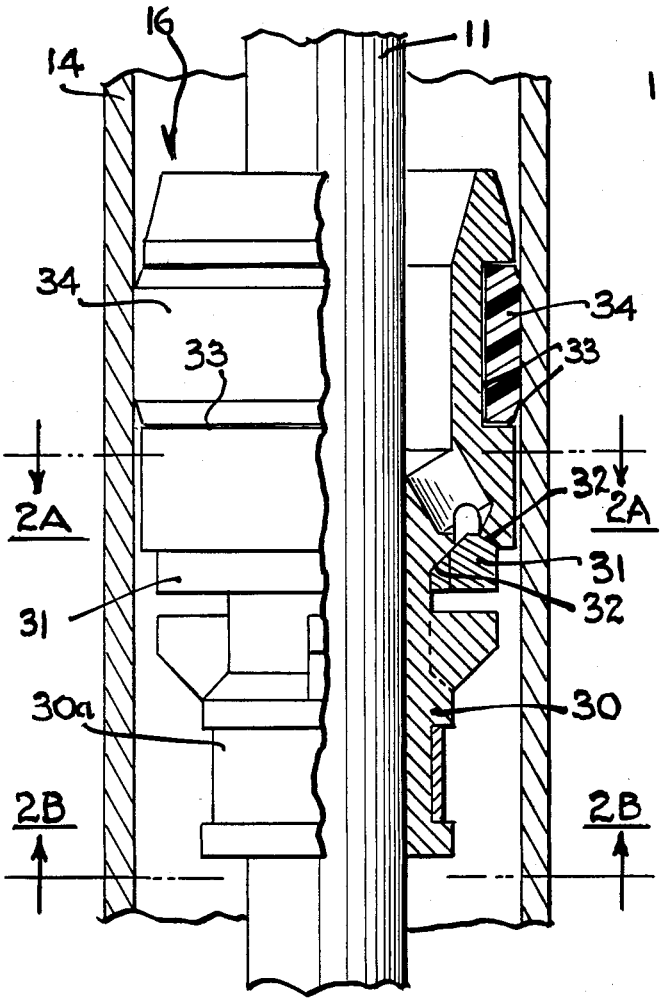
FIG. 2 is an elevational view with partial cut-away section illustrating one form of an impeller pump which may be employed in implementing the system of the invention.
Figure 2A:
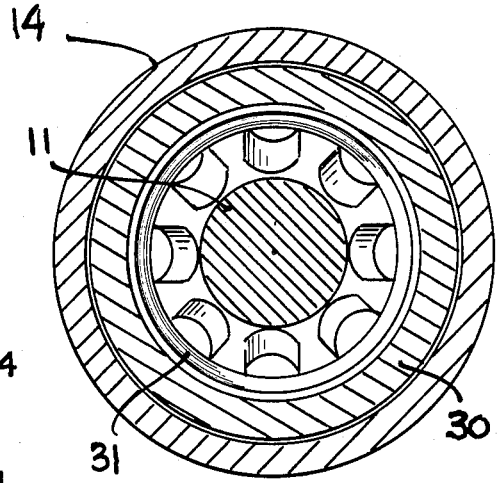
FIG. 2A is a cross-sectional view taken along the plane indicated by 2A—2A in FIG. 2.
Figure 2B:
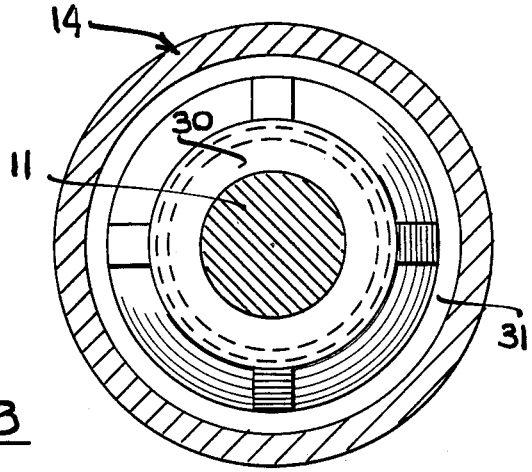
FIG. 2B is a cross-sectional view taken along the plane indicated by 2B—2B in FIG. 2.

Referring now to FIGS. 2, 2A and 2B, an impeller element 16 which may be employed in the system of the invention is illustrated. A check valve poppet member 31 in the form of a circular ring seats in a "V" groove 32 formed in the impeller body. An impeller body portion 30 is fixedly joined to the outer wall of rod 11 by means of clamp ring 30*a*. A ring member 34 which may be of Teflon is mounted on the body of the impeller in a groove provided therein in the nature of a piston ring to improve the sealing effect, this ring member engaging the inner wall of the tubing 14. A clearance gap 33 is provided between the outer wall of the piston ring groove in the impeller and the inner wall of the ring 34 to permit fluid pressure to be directed against ring 34 so as to momentarily expand and seal the ring against the tubing wall during the downward pressure pulses. The surfaces of the impeller and the piston ring surfaces in contact with the tubing are preferably fabricated of a soft material to provide compliant give for a foreign material such as sand and the like that may pass through the impeller so as to minimize scratching or harsh rubbing on the tubing wall. With the vibratory motion of the impeller, fluid is pumped downward through the poppet valves which open onthe upward phase, the valves closing to upward flow and causing downward drive during the downward vibratory phase. Air or gas bubbles tend to collect under the impellers, sometimes sufficiently to artifically soften the adjacent liquid column, i.e, lower its impedance, so as to inhibit downward sonic impulses provided by the impellers. Accordingly, one of the main functions of delivering pressurized fluid to inlet 15 is to keep these gases dissolved and bubbles collapsed.

While the invention has been described and illustrated in detail, it is to be clearly understood that this in intended by way of illustration and example only and is not to be taken by way of limitation, the spirit and scope of this invention being limited only by the terms of the following claims.

I claim:

1. A method for providing sonic downward pressure for fracturing an earthen formation surrounding the borehole of a well comprising the steps of:

installing an elongated elastic column member down said well, said elastic column member having a plurality of sonic impeller elements spaced therealong and oriented for downward pumping action, feeding pressurized fluid to said well at the upper end thereof, and applying sonic energy to said elastic column member at a frequency such as to cause resonant standing wave vibration thereof, thereby effecting pulsating downward pumping action of the fluid against the earthen structure at the bottom of said well, the spacing between adjacent impeller elements being small enough as compared with the wave length of said standing wave vibration such that adjacent impellers operate in close phase relationship with each other.

2. The method of claim 1 wherein said impeller elements are spaced from each other by a distance which is less than 1/10th the wavelength of the standing waves set up in said elastic member.

3. The method of claim 1 and further including the application of downward bias force on said elastic member great engough to substantially prevent upward displacement of said elastic member in response to the pumping action.

4. The method of claim 1 wherein the sonic energy is generated by means of an orbiting mass oscillator attached to said elastic member at the top end thereof.

* * * * *